US011660739B1

(12) United States Patent
Coffey

(10) Patent No.: US 11,660,739 B1
(45) Date of Patent: May 30, 2023

(54) ELEVATED TOOL BOX ASSEMBLY

(71) Applicant: Royce Coffey, Cameron Park (AU)

(72) Inventor: Royce Coffey, Cameron Park (AU)

( * ) Notice: Subject to any disclaimer, the term of this patent is extended or adjusted under 35 U.S.C. 154(b) by 0 days.

(21) Appl. No.: 17/522,046

(22) Filed: Nov. 9, 2021

(51) Int. Cl.
*B25H 3/02* (2006.01)
*E04G 5/00* (2006.01)

(52) U.S. Cl.
CPC ..... *B25H 3/02* (2013.01); *E04G 5/003* (2013.01)

(58) Field of Classification Search
CPC ..... B25H 3/02; E04G 5/003; E04G 5/004; E04G 5/048
USPC ..... 206/373; 248/227.4, 229.11–229.17
See application file for complete search history.

(56) References Cited

U.S. PATENT DOCUMENTS 5,547,080 A 8/1996 Klimas
7,077,238 B2 * 7/2006 Butler ..... E06C 7/14 248/210
7,275,641 B1 10/2007 Purnell
8,448,959 B1 5/2013 Pohot
8,881,917 B1 11/2014 Sooknanan
10,745,969 B1 * 8/2020 Robertson ..... E06C 7/14
2014/0097217 A1 * 4/2014 Walsh ..... A45F 5/02 224/268
2017/0014989 A1 1/2017 McGee
2018/0148224 A1 * 5/2018 Johnson ..... B25H 3/06
2022/0106798 A1 * 4/2022 Johnson ..... A45F 3/04

FOREIGN PATENT DOCUMENTS

GB 2325487 11/1998

* cited by examiner

*Primary Examiner* — Rafael A Ortiz
*Assistant Examiner* — Sanjidul Islam

(57) ABSTRACT

An elevated tool box assembly includes a tool box that has a pair of receivers that is each integrated into the tool box. Each of the receivers is oriented to extend along a horizontal axis to insertably receive a respective one of a plurality of horizontal members of a guard rail on an elevated platform. In this way the tool box can be suspended on the guard rail. The tool box has a crown and the crown has a plurality of slots integrated into the crown for receiving a hand tool for storage. A door is hingedly integrated into the crown for opening and closing the tool box. A plurality of suspensions is each coupled to the crown and a plurality of lanyards is each removably attachable to a respective one of the suspensions. Additionally, each of the lanyards is attachable to a respective one of the hand tools.

10 Claims, 7 Drawing Sheets

ELEVATED TOOL BOX ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tool box device and more particularly pertains to a new tool box device for inhibiting hand tools from being dropped from an elevated platform. The device includes a tool box and a pair of horizontally oriented receivers each integrated into the tool box. Each of the horizontal receivers engages a respective horizontal member of a guard rail on an elevated platform for mounting the tool box to the guard rail. The device includes a plurality of lanyards that are each releasably attachable to the tool box and which each engages a respective hand tool. In this way the respective hand tool is inhibited from being dropped from the elevated platform.

(2) Description of Related Art Including Information Disclosed Under 37 CFR 1.97 and 1.98

The prior art relates to tool box devices including a tool box which has a lip for engaging a rung on a ladder to suspend the tool box from the ladder. The prior art discloses a tool box that has a bracket for engaging a horizontal member of a guard rail on an elevated platform. The prior art discloses a tool storage device that includes a bracket for engaging a topmost rail of a guard rail on a scaffold. The prior art discloses a tool box that includes a pair of concave members which engage respective vertical members of a scaffold to mount the tool box to the scaffold.

BRIEF SUMMARY OF THE INVENTION

An embodiment of the disclosure meets the needs presented above by generally comprising a tool box that has a pair of receivers that is each integrated into the tool box.

Each of the receivers is oriented to extend along a horizontal axis to insertably receive a respective one of a plurality of horizontal members of a guard rail on an elevated platform. In this way the tool box can be suspended on the guard rail. The tool box has a crown and the crown has a plurality of slots integrated into the crown for receiving a hand tool for storage. A door is hingedly integrated into the crown for opening and closing the tool box. A plurality of suspensions is each coupled to the crown and a plurality of lanyards is each removably attachable to a respective one of the suspensions. Additionally, each of the lanyards is attachable to a respective one of the hand tools to inhibit the hand tools from being dropped from the elevated platform.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
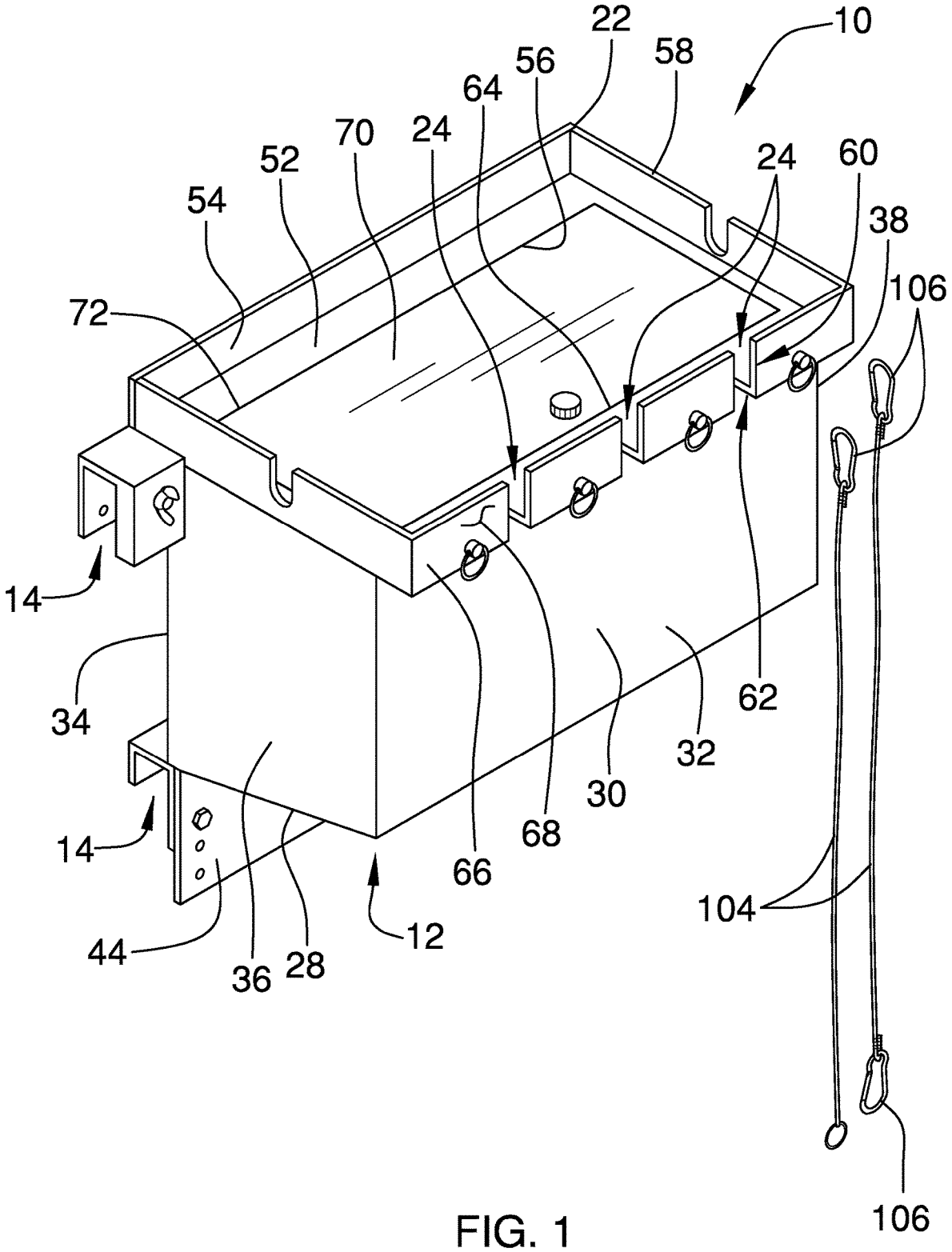
FIG. 1 is a top perspective view of an elevated tool box assembly according to an embodiment of the disclosure.
Figure 2:
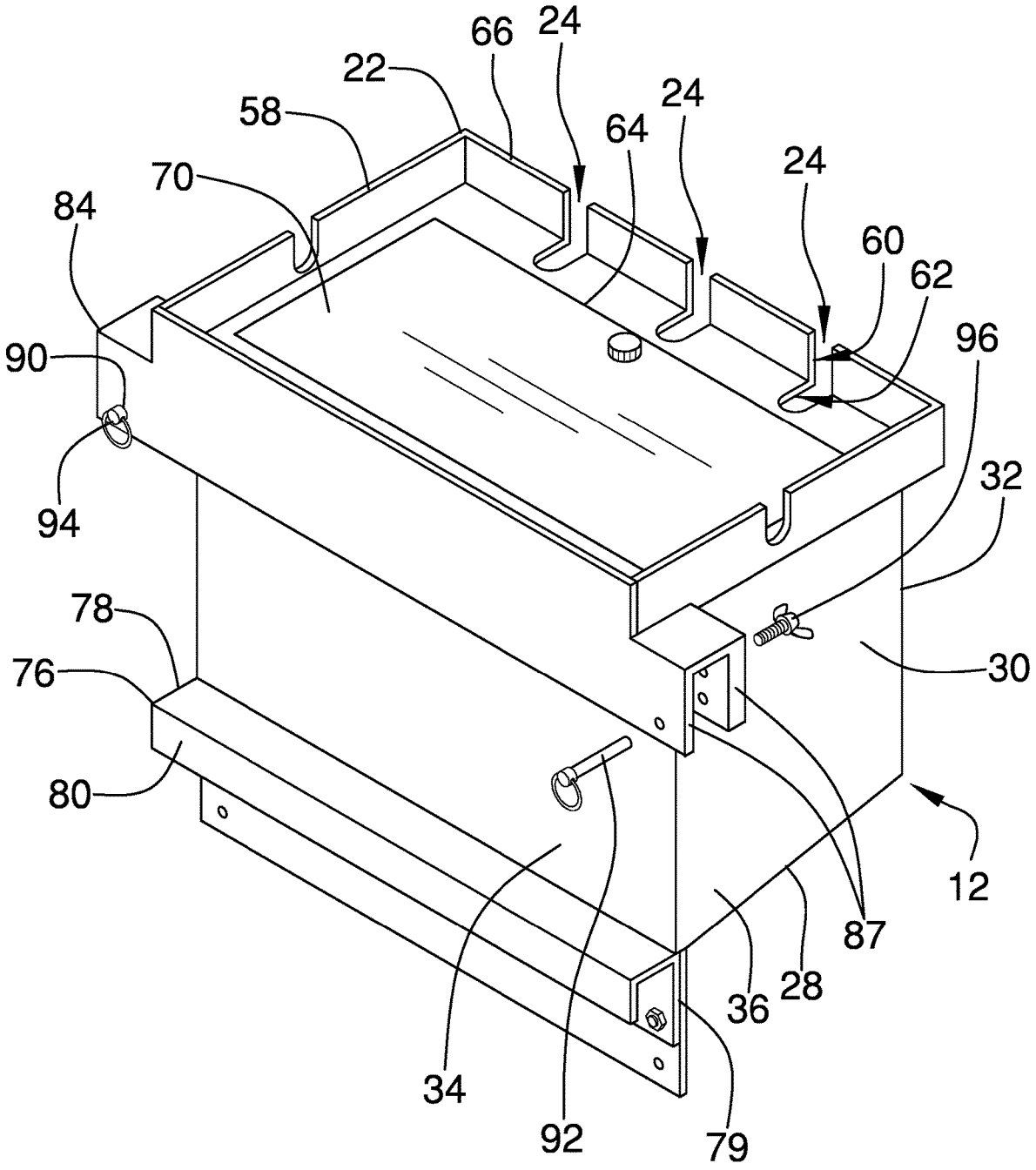
FIG. 2 is a back perspective view of an embodiment of the disclosure.
Figure 3:
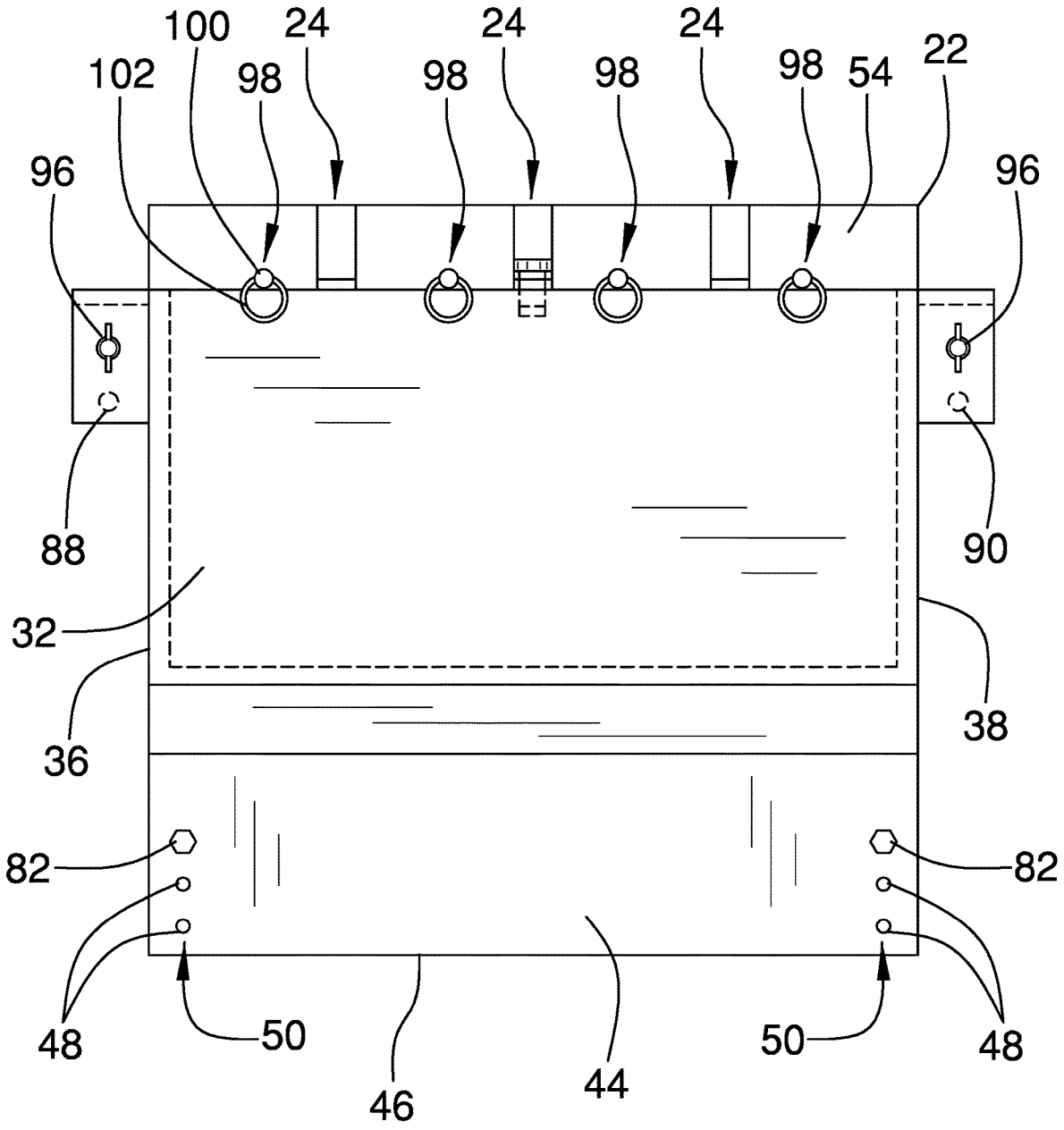
FIG. 3 is a front view of an embodiment of the disclosure.
Figure 4:
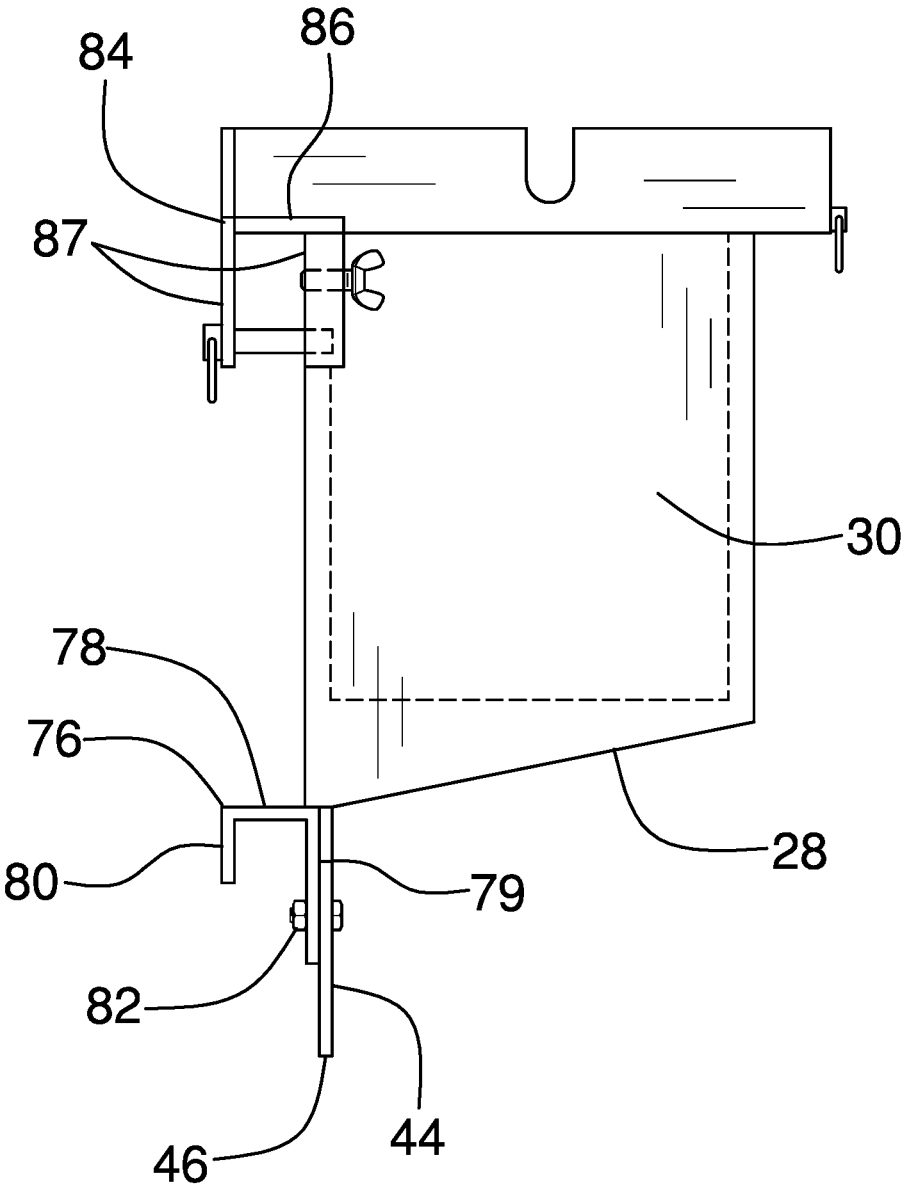
FIG. 4 is a left side view of an embodiment of the disclosure.
Figure 5:
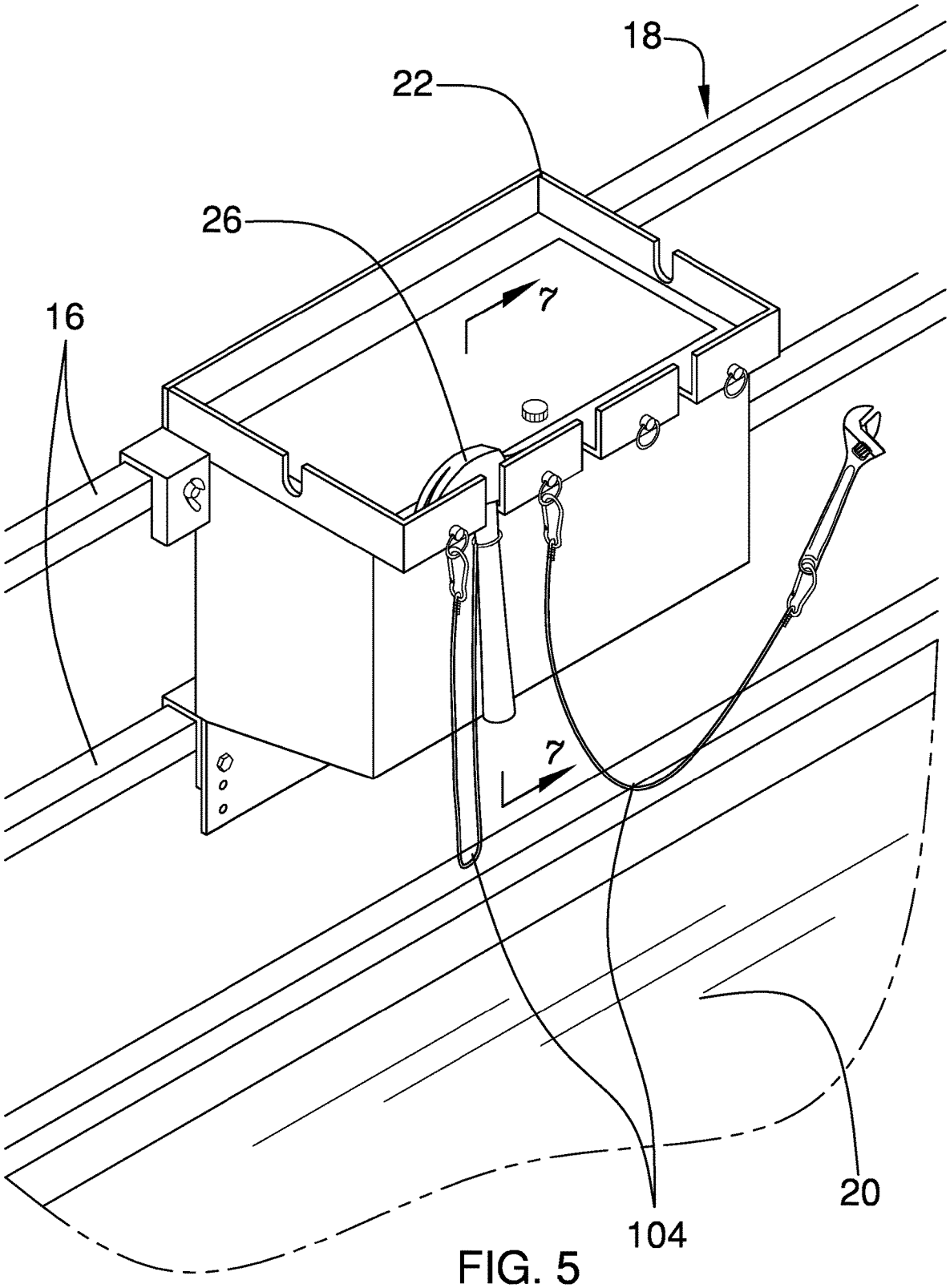
FIG. 5 is a perspective in-use view of an embodiment of the disclosure.
Figure 6:
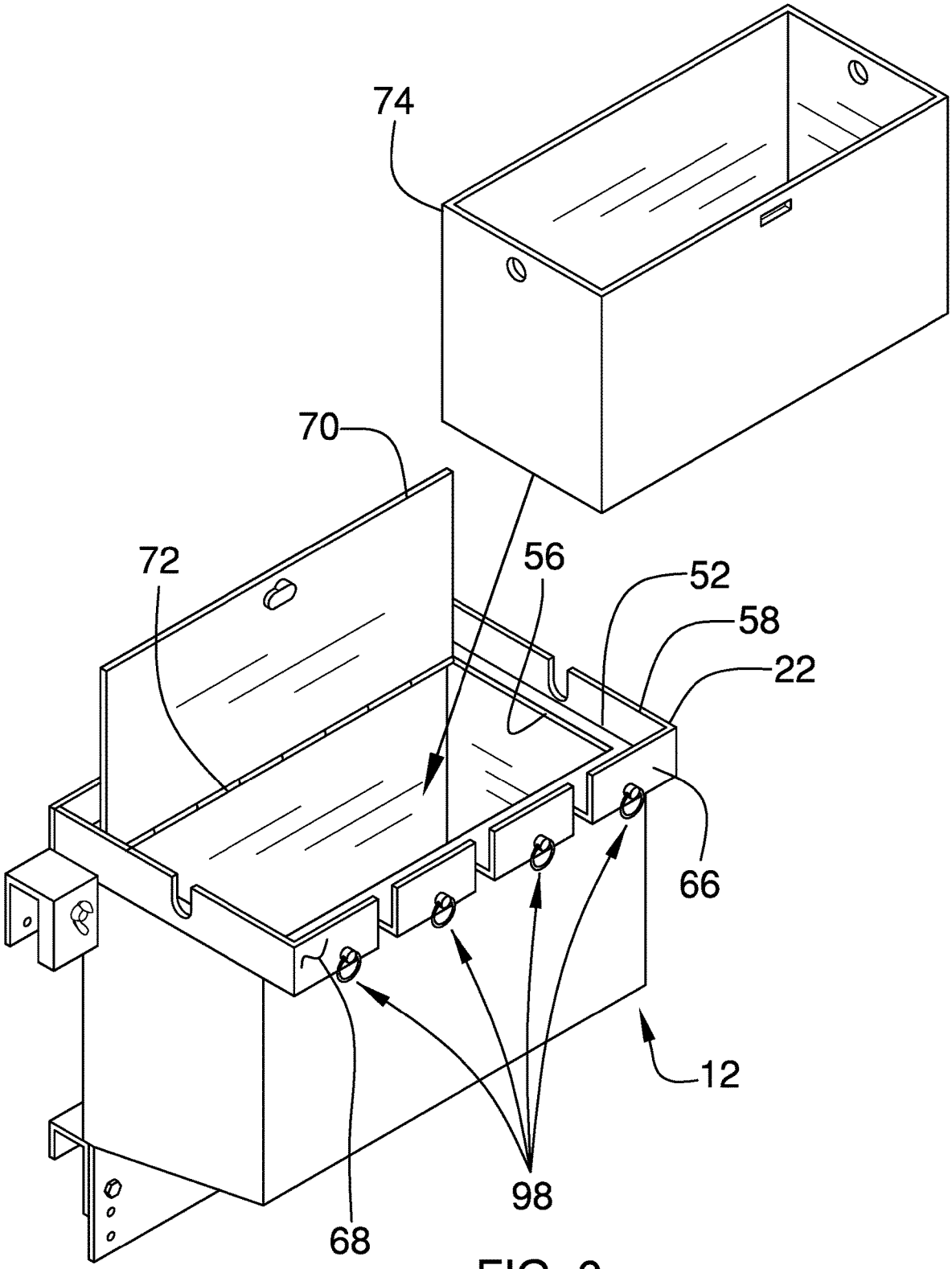
FIG. 6 is an exploded perspective view of an embodiment of the disclosure.
Figure 7:
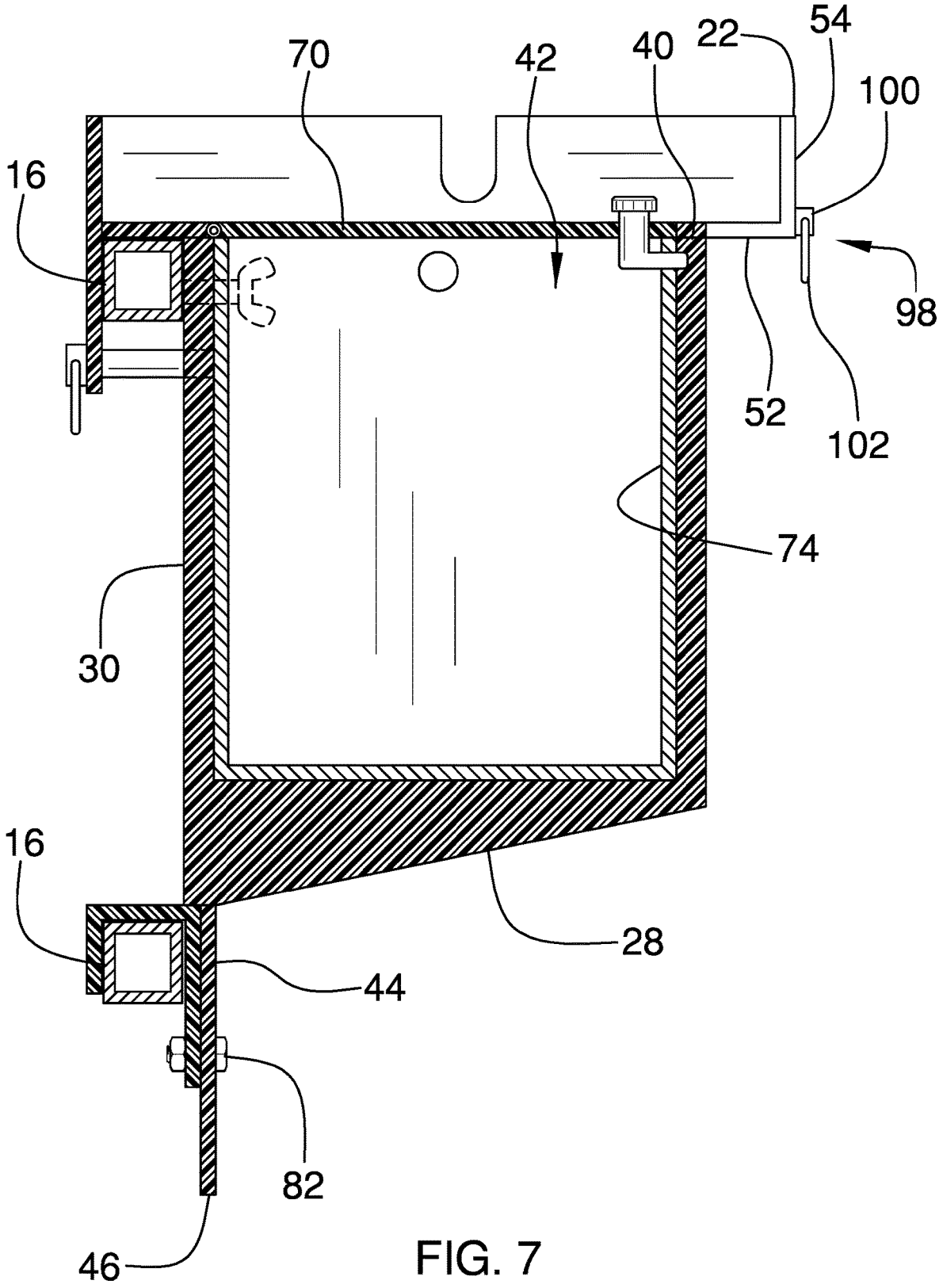
FIG. 7 is a cross sectional view taken along line 7-7 of FIG. 5 of an embodiment of the disclosure.

With reference now to the drawings, and in particular to FIGS. 1 through 7 thereof, a new tool box device embodying the principles and concepts of an embodiment of the disclosure and generally designated by the reference numeral 10 will be described.

As best illustrated in FIGS. 1 through 7, the elevated tool box assembly 10 generally comprises a tool box 12 that has a pair of receivers 14 each being integrated into the tool box 12. Each of the receivers 14 is oriented to extend along a horizontal axis to insertably receive a respective one of a plurality of horizontal members 16 of a guard rail 18 on an elevated platform 20. In this way the tool box 12 can be suspended on the guard rail 18. The elevated platform 20 may be a bucket of a bucket lift, a scissor lift, scaffolding or any other type of elevated platform commonly employed by a service worker. The tool box 12 has a crown 22, the crown 22 has a plurality of slots 24 each being integrated into the crown 22 and each of the slots 24 can receive a hand tool 26 for storage.

The tool box 12 has a bottom wall 28 and an outer wall 30 extending upwardly from the bottom wall 28, and the outer wall 30 has a front side 32, a back side 34, a first lateral side 36, a second lateral side 38 and a distal edge 40 with respect to the bottom wall 28 defining an opening 42 into an interior of the tool box 12. The bottom wall 28 angles upwardly between the back side 34 and the front side 32, and a panel 44 extends downwardly from the bottom wall 28. The panel 44 has a distal edge 46 with respect to the bottom wall 28, the panel 44 is positioned adjacent to the back side 34 and the panel 44 is coextensive with the back side 34. The panel 44 has a plurality of holes 48 each extending through the panel 44, and the holes 48 are arranged in a pair of columns 50 each extending between the bottom wall 28 and the distal edge 40 of the panel 44.

The crown 22 has a lower wall 52 and a perimeter wall 54 extending upwardly from the lower wall 52, and the lower wall 52 has a hole 56 extending through the lower wall 52. The lower wall 52 is positioned on the distal edge 40 of the outer wall 30 of the tool box 12 having the hole 56 in the lower wall 52 being aligned with the opening 42 defined by the distal edge 40 of the outer wall 30. The perimeter wall 54 has a top edge 58 and each of the slots 24 has a first portion 60 extending between the top edge 58 and the lower wall 52. Furthermore, each of the slots 24 has a second portion 62 extending between the first portion 60 and a bounding edge 64 of the hole 56 extending through the lower wall 52. The slots 24 are spaced apart from each other and are distributed along a forward side 66 of the perimeter wall 54 of the crown 22, and the forward side 66 has a forward surface 68.

A door 70 is hingedly integrated into the crown 22 for opening 42 and closing the tool box 12. The door 70 has a rear edge 72 and the rear edge 72 is hingedly coupled to the bounding edge 64 of the hole 56 in the lower wall 52 of the crown 22. The door 70 closes the hole 56 in the lower wall 52 when the door 70 is closed and the door 70 exposes the hole 56 in the lower wall 52 when the door 70 is opened. As is most clearly shown in FIG. 6, a box 74 is provided that is insertable into the hole 56 in the lower wall 52 for storing the box 74 inside of the tool box 12. The box 74 can contain hand tools, parts, accessories or any other object the service worker may need to employ.

A first bracket 76 is provided that has a central portion 78 extending between a front portion 79 and a rear portion 80. Each of the rear portion 80 and the front portion 79 extends downwardly from the central portion 78 such that the first bracket 76 has a U-shape. The front portion 79 has a length that is greater than the rear portion 80. The front portion 79 is positioned against the panel 44 having the first bracket 76 extending downwardly from the bottom wall 28 of the tool box 12 such that the first bracket 76 defines a respective one of the receivers 14. A pair of fasteners 82 is each extendable through a respective one of the holes 48 in a respective one of the columns 50 in the panel 44 on the tool box 12. Each of the fasteners 82 engages the front portion 79 of the panel 44 for adjustably retaining the first bracket 76 on the panel 44. Additionally, the fasteners 82 may comprise a nut and a bolt or other type of releasable, mechanical fastener.

A second bracket 84 is provided which has a middle portion 86 extending between a pair of lateral portions 87. Each of the lateral portions 87 extends downwardly from the middle portion 86 such that the second bracket 84 has a U-shape. The middle portion 86 is coupled to the lower wall 52 of the crown 22 having each of the lateral portions 87 extending downwardly with respect to the crown 22 such that the second bracket 84 defines a respective one of the receivers 14. Each of the lateral portions 87 has a first hole 88 extending therethrough and the first hole 88 in each of the lateral portions 87 is aligned with each other. Additionally, each of the lateral portions 87 has a second hole 90 extending therethrough and the second hole 90 in each of the lateral portions 87 is aligned with each other. Furthermore, each of the first holes 88 is positioned on an opposing end of the second bracket 84 with respect to the second holes 90.

A first pin 92 is insertable through each of the first holes 88 to inhibit the second bracket 84 from being lifted from the respective horizontal member 16 of the guard rail 18. A second pin 94 is insertable through each of the second holes 90 to inhibit the second bracket 84 from being lifted from the respective horizontal member 16 of the guard rail 18. In this way the tool box 12 is secured to the guard rail 18 to inhibit the tool box 12 from falling from the elevated platform 20. Thus, individuals are protected from sustaining an injury that could result from being struck by the tool box 12 falling on them from above. A pair of set screws 96 may be provided and each of the set screws 96 may be extendable through a respective lateral portion 86 of the second bracket 84 to engage the horizontal member upon which the second bracket 84 is positioned.

A plurality of suspensions 98 is provided and each of the suspensions 98 is coupled to the crown 22. Each of the suspensions 98 comprises a stem 100 and a ring 102 that is movably coupled to the stem 100. The stem 100 of each of the suspensions 98 extends forwardly from the forward side 66 of the crown 22. Additionally, each of the suspensions 98 is positioned between a respective pair of the slots 24 in the crown 22.

A plurality of lanyards 104 is provided and each of the lanyards 104 is removably attachable to a respective one of the suspensions 98. Each of the lanyards 104 is attachable to a respective hand tool 26 to inhibit the hand tool 26 from is dropped from the elevated platform 20. In this way individuals are protected from being injured by a falling hand tool 26. Each of the lanyards 104 includes a pair of couplers 106, including but not being limited to, a D-ring, a lobster claw or other type of releasable coupler. Each of the couplers 106 is disposed on opposing ends of a respective lanyard 104. A respective one of the couplers 106 on each of the lanyards 104 releasably engages the ring 102 on the respective suspension 98. Furthermore, a respective one of the couplers 106 on each of the lanyards 104 releasably engages the respective hand tool 26.

In use, each of the first bracket 76 and the second bracket 84 are positioned on the respective horizontal member of the guard rail 18 to suspend the tool box 12 on the guard rail 18. Each of the first pin 92 and the second pin 94 are inserted through the respective first holes 88 and second holes 90 to secure the tool box 12 to the horizontal members 16. Each of the lanyards 104 is attached to the respective hand tool 26. In this way the respective hand tool 26 is inhibited from being dropped from the elevated platform 20. In this way the service worker can employ hand tools 26 on the elevated platform 20 without endangering 102 individuals on the ground from being struck by a falling hand tool 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An elevated tool box assembly for inhibiting tools from being dropped from an elevated platform, said assembly comprising:

a tool box having a pair of receivers each being integrated into said tool box, each of said receivers being oriented to extend along a horizontal axis wherein each of said receivers is configured to insertably receive a respective one of a plurality of horizontal members of a guard rail on an elevated platform thereby facilitating said tool box to be suspended on the guard rail, said tool box having a crown, said crown having a plurality of slots each being integrated into said crown wherein each of said slots is configured to have a hand tool positioned therein for storage;

a door being hingedly integrated into said crown for opening and closing said tool box;

a plurality of suspensions, each of said suspensions being coupled to said crown;

a plurality of lanyards, each of said lanyards being removably attachable to a respective one of said suspensions, each of said lanyards being attachable to a respective one of the hand tools wherein said plurality of lanyards is configured to inhibit the hand tools from being dropped from the elevated platform;

wherein said tool box has a bottom wall and an outer wall extending upwardly from said bottom wall, said outer wall having a front side, a back side, a first lateral side, a second lateral side and a distal edge with respect to said bottom wall defining an opening into an interior of said tool box, said bottom wall angling upwardly between said back side and said front side;

wherein said bottom wall has a panel extending downwardly from said bottom wall, said panel having a distal edge with respect to said bottom wall, said panel being positioned adjacent to said back side, said panel being coextensive with said back side, said panel having a plurality of holes each extending through said panel, said holes being arranged in a pair of columns each extending between said bottom wall and said distal edge of said panel; and wherein said crown has a lower wall and a perimeter wall extending upwardly from said lower wall, said lower wall having an hole extending through said lower wall, said lower wall being positioned on said distal edge of said outer wall of said tool box having said hole in said lower wall being aligned with said opening defined by said distal edge of said outer wall, said perimeter wall having a top edge, each of said slots having a first portion extending between said top edge and said lower wall, each of said slots having a second portion extending between said first portion and a bounding edge of said hole extending through said lower wall, said slots being spaced apart from each other and being distributed along a forward side of said perimeter wall of said crown, said forward side having a forward surface.

2. The assembly according to claim 1, wherein said door has a rear edge, said rear edge being hingedly coupled to said bounding edge of said hole in said lower wall of said crown, said door closing said hole in said lower wall when said door is closed, said door exposing said hole in said lower wall when said door is opened.

3. The assembly according to claim 1, further comprising a first bracket having a central portion extending between a front portion and a rear portion, each of said rear portion and said front portion extending downwardly from said central portion such that said first bracket has a U-shape, said front portion having a length being greater than said rear portion, said front portion being positioned against panel extending downwardly from said bottom wall of said tool box such that said first bracket defines a respective one of said receivers.

4. The assembly according to claim 3, further comprising a pair of fasteners, each of said fasteners being extendable through a respective one of said holes in a respective one of said columns in said panel on said tool box, each of said fasteners engaging said front portion of said panel for adjustably retaining said first bracket on said panel.

5. The assembly according to claim 3, further comprising a second bracket having a middle portion extending between a pair of lateral portions, each of said lateral portions extending downwardly from said middle portion such that said second bracket has a U-shape, said middle portion being coupled to said lower wall of said crown having each of said lateral portions extending downwardly with respect to said crown such that said second bracket defines a respective one of said receivers.

6. The assembly according to claim 5, wherein:

each of said lateral portions has a first hole extending therethrough, said first hole in each of said lateral portions being aligned with each other; and each of said lateral portions has a second hole extending therethrough, said second hole in each of said lateral portions being aligned with each other, each of said first holes being positioned on an opposing end of said second bracket with respect to said second holes.

7. The assembly according to claim 6, further comprising:

a first pin being insertable through each of said first holes wherein said first pin is configured to inhibit said second bracket from being lifted from the respective horizontal member of the guard rail; and a second pin being insertable through each of said second holes wherein said second pin is configured to inhibit said second bracket from being lifted from the respective horizontal member of the guard rail.

8. The assembly according to claim 1, wherein each of said suspensions comprises a stem and a ring being movably coupled to said stem, said stem of each of said suspensions extending forwardly from said forward side of said crown, each of said suspensions being positioned between a respective pair of said slots in said crown.

9. The assembly according to claim 8, wherein each of said lanyards includes a pair of couplers, each of said couplers being disposed on opposing ends of said lanyard, a respective one of said couplers on each of said lanyards releasably engaging said ring on said respective suspension, a respective one of said couplers on each of said lanyards releasably engaging the respective hand tool.

10. An elevated tool box assembly for inhibiting tools from being dropped from an elevated platform, said assembly comprising:

a tool box having a pair of receivers each being integrated into said tool box, each of said receivers being oriented to extend along a horizontal axis wherein each of said receivers is configured to insertably receive a respective one of a plurality of horizontal members of a guard rail on an elevated platform thereby facilitating said tool box to be suspended on the guard rail, said tool box having a crown, said crown having a plurality of slots each being integrated into said crown wherein each of said slots is configured to have a hand tool positioned therein for storage, said tool box having a bottom wall and an outer wall extending upwardly from said bottom wall, said outer wall having a front side, a back side, a first lateral side, a second lateral side and a distal edge with respect to said bottom wall defining an opening into an interior of said tool box, said bottom wall angling upwardly between said back side and said front side, said bottom wall having a panel extending downwardly from said bottom wall, said panel having a distal edge with respect to said bottom wall, said panel being positioned adjacent to said back side, said panel being coextensive with said back side, said panel having a plurality of holes each extending through said panel, said holes being arranged in a pair of columns each extending between said bottom wall and said distal edge of said panel, said crown having a lower wall and a perimeter wall extending upwardly from said lower wall, said lower wall having a hole extending through said lower wall, said lower wall being positioned on said distal edge of said outer wall of said tool box having said hole in said lower wall being aligned with said opening defined by said distal edge of said outer wall, said perimeter wall having a top edge, each of said slots having a first portion extending between said top edge and said lower wall, each of said slots having a second portion extending between said first portion and a bounding edge of said hole extending through said lower wall, said slots being spaced apart from each other and being distributed along a forward side of said perimeter wall of said crown, said forward side having a forward surface;

a door being hingedly integrated into said crown for opening and closing said tool box, said door having a rear edge, said rear edge being hingedly coupled to said bounding edge of said hole in said lower wall of said crown, said door closing said hole in said lower wall when said door is closed, said door exposing said hole in said lower wall when said door is opened;

a first bracket having a central portion extending between a front portion and a rear portion, each of said rear portion and said front portion extending downwardly from said central portion such that said first bracket has a U-shape, said front portion having a length being greater than said rear portion, said front portion being positioned against panel extending downwardly from said bottom wall of said tool box such that said first bracket defines a respective one of said receivers;

a pair of fasteners, each of said fasteners being extendable through a respective one of said holes in a respective one of said columns in said panel on said tool box, each of said fasteners engaging said front portion of said panel for adjustably retaining said first bracket on said panel;

a second bracket having a middle portion extending between a pair of lateral portions, each of said lateral portions extending downwardly from said middle portion such that said second bracket has a U-shape, said middle portion being coupled to said lower wall of said crown having each of said lateral portions extending downwardly with respect to said crown such that said second bracket defines a respective one of said receivers, each of said lateral portions having a first hole extending therethrough, said first hole in each of said lateral portions being aligned with each other, each of said lateral portions having a second hole extending therethrough, said second hole in each of said lateral portions being aligned with each other, each of said first holes being positioned on an opposing end of said second bracket with respect to said second holes;

a first pin being insertable through each of said first holes wherein said first pin is configured to inhibit said second bracket from being lifted from the respective horizontal member of the guard rail;

a second pin being insertable through each of said second holes wherein said second pin is configured to inhibit said second bracket from being lifted from the respective horizontal member of the guard rail;

a plurality of suspensions, each of said suspensions being coupled to said crown, each of said suspensions comprising a stem and a ring being movably coupled to said stem, said stem of each of said suspensions extending forwardly from said forward side of said crown, each of said suspensions being positioned between a respective pair of said slots in said crown; and a plurality of lanyards, each of said lanyards being removably attachable to a respective one of said suspensions, each of said lanyards being attachable to a respective one of the hand tools wherein said plurality of lanyards is configured to inhibit the hand tools from being dropped from the elevated platform, each of said lanyards including a pair of couplers, each of said couplers being disposed on opposing ends of said lanyard, a respective one of said couplers on each of said lanyards releasably engaging said ring on said respective suspension, a respective one of said couplers on each of said lanyards releasably engaging the respective hand tool.

* * * * *